US011248860B2

(12) United States Patent
Schneider et al.

(10) Patent No.: US 11,248,860 B2
(45) Date of Patent: Feb. 15, 2022

(54) FLEXIBLE LANCE DRIVE POSITIONER APPARATUS

(71) Applicant: STONEAGE, INC., Durango, CO (US)

(72) Inventors: Joseph A. Schneider, Durango, CO (US); Jeffery R. Barnes, Ignacio, CO (US); John L. Krauser, Durango, CO (US)

(73) Assignee: STONEAGE, INC., Durango, CO (US)

( * ) Notice: Subject to any disclaimer, the term of this patent is extended or adjusted under 35 U.S.C. 154(b) by 191 days.

(21) Appl. No.: 16/791,396

(22) Filed: Feb. 14, 2020

(65) Prior Publication Data

US 2020/0263941 A1 Aug. 20, 2020

Related U.S. Application Data

(60) Provisional application No. 62/857,703, filed on Jun. 5, 2019, provisional application No. 62/825,142, filed (Continued)

(51) Int. Cl.

| | |
|---|---|
| ***F28G 15/02*** | (2006.01) |
| ***F28G 9/00*** | (2006.01) |
| ***F28G 15/04*** | (2006.01) |

(52) U.S. Cl.

CPC ..... *F28G 15/02* (2013.01); *F28G 9/00* (2013.01); *F28G 15/04* (2013.01)

(58) Field of Classification Search

CPC . F28G 15/02; F28G 15/04; F28G 1/16; F28G 1/163; F28G 15/00; B08B 9/04

(Continued)

(56) References Cited

U.S. PATENT DOCUMENTS 4,095,305 A * 6/1978 Goodwin ..... F28G 3/10 134/167 C
5,022,463 A * 6/1991 Boisture ..... B65H 75/4402 122/379

(Continued)

FOREIGN PATENT DOCUMENTS

| | | | | |
|---|---|---|---|---|
| CA | 2158829 A1 * | 3/1997 | ..... | F28G 1/16 |
| FR | 2563331 A1 * | 10/1985 | ..... | F28G 1/163 |
| GB | 1027717 A * | 4/1966 | ..... | F28G 1/08 |

OTHER PUBLICATIONS

International Search Report and Written Opinion, dated Jun. 22, 2020, from corresponding International Patent App. No. PCT/US2020/018264.

*Primary Examiner* — Len Tran
*Assistant Examiner* — Jenna M Hopkins
(74) *Attorney, Agent, or Firm* — Greenberg Traurig, LLP

(57) ABSTRACT

An apparatus for positioning a flexible lance drive device in registry with an opening into a heat exchanger tube sheet includes a flat plate bracket adapted to be bolted parallel to a flange of the heat exchanger. The bracket carries a stub tube fastened to and extending normal to the flat bracket. A rotary drive is removably fastened to the stub tube and has a rotary disc rotatable in a plane parallel to the tube sheet. A slotted box rail has a proximal end clamped to the rotary disc and a linear drive assembly is removably fastened to the slotted box rail. A guide tube collet block assembly clamped to the linear drive assembly removably supports a flexible lance drive and guide tube to guide a flexible lance between the lance drive and a selected one of a plurality of tubes penetrating through the heat exchanger tube sheet.

20 Claims, 16 Drawing Sheets

Related U.S. Application Data on Mar. 28, 2019, provisional application No. 62/808,203, filed on Feb. 20, 2019.

(58) Field of Classification Search
USPC ..... 269/1
See application file for complete search history.

(56) References Cited

U.S. PATENT DOCUMENTS 5,184,636 A * 2/1993 van der Woude ..... F28G 15/04 134/167 C
5,265,805 A * 11/1993 Artenian ..... A47L 11/26 239/135
5,348,234 A * 9/1994 v.d. Woude ..... F28G 15/02 239/753
5,570,660 A * 11/1996 Vandenberg ..... F22B 37/483 122/379
5,782,209 A * 7/1998 Vandenberg ..... F22B 37/483 122/379
6,626,195 B1 * 9/2003 Garman ..... B08B 9/0433 134/104.1
6,681,839 B1 * 1/2004 Balzer ..... F28G 1/163 122/379
7,178,534 B2 * 2/2007 Garman ..... B08B 9/0433 134/167 C
7,530,363 B2 * 5/2009 Garman ..... B08B 9/0433 134/166 C
8,757,104 B2 * 6/2014 Hawkins ..... F22B 37/003 122/379
9,328,979 B2 * 5/2016 Brumfield ..... F28G 15/02
9,400,145 B2 * 7/2016 Mathis ..... F16L 3/223
9,605,915 B2 * 3/2017 Crock ..... F28G 1/16
9,630,801 B2 * 4/2017 Barnes ..... B08B 9/0433
9,851,164 B2 * 12/2017 Hand ..... F28G 1/163
9,950,348 B2 * 4/2018 Zink ..... B08B 9/0433
10,024,613 B2 * 7/2018 Mathis ..... F28G 15/04
10,048,027 B2 * 8/2018 Eisermann ..... F28G 1/163
10,272,480 B2 * 4/2019 Zink ..... F28G 1/163
10,336,571 B2 * 7/2019 Barnes ..... B65H 75/364
10,401,878 B2 * 9/2019 Gromes, Sr ..... G06F 3/04886
10,408,552 B2 * 9/2019 Gromes, Sr ..... F28G 15/003
10,480,874 B2 * 11/2019 Zink ..... F28G 15/02
10,684,082 B2 * 6/2020 Mathis ..... F28G 3/163
10,809,023 B2 * 10/2020 Krauser ..... F28G 3/163
2004/0069331 A1 * 4/2004 Garman ..... B65H 51/10 134/167 C
2011/0155174 A1 * 6/2011 Moll ..... B08B 9/027 134/8
2012/0067370 A1 * 3/2012 Crock ..... F28G 3/163 134/6
2012/0103368 A1 * 5/2012 Gromes, Sr. ..... F28G 15/02 134/22.12
2015/0034128 A1 * 2/2015 Brumfield ..... F28G 1/163 134/22.11
2015/0068563 A1 * 3/2015 Gzym ..... F28G 15/003 134/168 C
2016/0025432 A1 * 1/2016 Mathis ..... F16L 3/223 248/68.1
2016/0025433 A1 * 1/2016 Mathis ..... F28G 3/163 269/1
2016/0243597 A1 * 8/2016 Shawver ..... F28G 15/08
2017/0102195 A1 * 4/2017 Watkins ..... F28G 1/04
2017/0107076 A1 * 4/2017 Barnes ..... B65H 57/12
2017/0108300 A1 * 4/2017 Brumfield ..... F28G 15/02
2017/0343308 A1 * 11/2017 Wojciechowski, III ..... F28G 1/163
2017/0356702 A1 * 12/2017 Gromes, Sr ..... F28G 15/04
2018/0058783 A1 * 3/2018 Zink ..... F28G 3/163
2018/0161833 A1 6/2018 Zink et al.
2018/0281030 A1 * 10/2018 Eisermann ..... B01D 29/66
2019/0039209 A1 * 2/2019 Curran ..... F28G 1/163
2020/0263941 A1 * 8/2020 Schneider ..... F28G 15/02

* cited by examiner

FLEXIBLE LANCE DRIVE POSITIONER APPARATUS

CROSS-REFERENCE TO RELATED APPLICATION

This application claims the benefit of priority to U.S. Patent Application No. 62/808,203, filed Feb. 20, 2020 and claims benefit of priority of U.S. Patent Application No. 62/825,142, filed Mar. 28, 2020, and claims benefit of priority of U.S. Patent Application No. 62/857,703, filed Jun. 5, 2019, each entitled "FLEXIBLE LANCE DRIVE POSITIONER APPARATUS". Each of these applications is incorporated herein by reference in its entirety.

BACKGROUND OF THE DISCLOSURE

The present disclosure is directed to high pressure fluid rotary nozzle systems. In particular, embodiments of the present disclosure are directed to an apparatus mounted on a heat exchanger tube sheet for positioning a flexible lance tractor drive device in aligned registry with a selected tube in a heat exchanger.

Conventional lance positioner frames are heavy rigid frame structures that can be assembled adjacent a heat exchanger once the tube sheet flange cover has been removed. U.S. Pat. No. 10,024,613 disclose a lightweight rectilinear frame adapted to be positioned adjacent or fastened to a heat exchanger tube sheet. Another solution is an apparatus attached directly to a heat exchanger tube sheet flange as described in US Patent Publication No. 2017/0108300. Such assemblies require a substantial amount of space adjacent to the tube sheet which may limit the feasibility of using such assemblies in confined spaces. What is needed is a more compact apparatus for precisely positioning one or more cleaning lances in registry with a heat exchanger tube sheet that is portable, simple to erect, remains rigid, and takes up minimal space adjacent the tube sheet.

SUMMARY OF THE DISCLOSURE

One embodiment in accordance with the present disclosure may be viewed as an apparatus for positioning a flexible lance drive device in registry with an opening into a heat exchanger tube sheet. This apparatus includes a flat plate bracket adapted to be bolted parallel to a flange of the heat exchanger adjacent the heat exchanger tube sheet so as to extend parallel to the flange. This bracket carries a stub tube fastened to and extending normal to the flat bracket. The stub tube has a central axis and a plurality of lateral through bores through the side wall of the tube intersecting the central axis.

A rotary drive is removably fastened to the stub tube. This rotary drive has a first air motor coupled through a worm gear to a rotary disc rotatable in a plane parallel to the tube sheet. A slotted box rail has a proximal end clamped to the rotary disc of the rotary drive and a linear drive assembly is removably fastened to the slotted box rail. The linear drive assembly includes a second air motor coupled to a drive sprocket configured to engage slots in the slotted box rail for movement of the linear drive assembly back and forth along the slotted rail.

A guide tube collet block assembly is clamped to the linear drive assembly. This guide tube collet block assembly is configured to removably support a flexible lance drive and guide a flexible lance from the drive between the lance drive and through the guide tube to a selected one of a plurality of tubes penetrating through the heat exchanger tube sheet in order to feed the flexible lance into, through and back out of the selected tube. The lance drive includes a guide tube removably fastened to the collet block via a bolted collet block cap.

In one embodiment, each of the through bores in the stub tube is spaced 30 degrees apart from an adjacent through bore and the rotary drive has a tubular coupling sleeve adapted to fit over the stub tube and may be selectively fixed on the stub tube with a locking pin extending through the coupling and through an aligned pair of stub tube through bores.

The guide tube collet block assembly preferably includes a generally rectangular collet block fastened to one end of a guide tube and a dovetail slide fastened to one side of the collet block. This dovetail slide is adapted to fit within a complementary clamp slot in the linear drive assembly to hold the guide tube collet block assembly firmly to the linear drive assembly.

The linear drive assembly preferably includes a pair of opposed rail slides fastened to a carriage plate for engaging raised corners of the box rail and guides the linear drive assembly as it is driven via the drive sprocket engaging slots along the box rail.

The apparatus also includes a control station configured to rest on a horizontal surface such as a floor. The control station supports control air pressure regulator, inline oiler and a removable tethered remote box to permit a user to move away from the control station while controlling feed rate of the flexible lance, rotation of the of box rail via the rotary plate and linear position of the collet block and guide tube along the box rail. The control Station is connected to the air motors via suitable air hoses.

An embodiment of the apparatus for positioning a flexible lance drive device in registry with an opening into a heat exchanger tube sheet may preferably be viewed as including a trapezoidal shaped flat plate bracket adapted to be bolted parallel to and against a flange of the heat exchanger adjacent the heat exchanger tube sheet so as to extend parallel to the flange. This bracket carries a stub tube fastened to and extending normal to the flat bracket. The stub tube has a central axis and a plurality of lateral through bores intersecting the central axis.

The apparatus also includes a rotary drive removably fastened to the stub tube via a sleeve receiving the stub tube therein. The rotary drive has a first air motor coupled through reduction gears and a worm gear to a rotary disc rotatable in a plane parallel to the tube sheet. A slotted box rail has a proximal end removably clamped to the rotary disc of the rotary drive. A linear drive assembly is removably fastened to the slotted box rail. The linear drive assembly includes a second air motor coupled to a drive sprocket configured to engage slots in the slotted box rail for movement of the linear drive assembly back and forth along the slotted rail.

A guide tube collet block assembly is clamped to the linear drive assembly. The guide tube collet block assembly is configured to removably support a flexible lance drive and guide a flexible lance between the lance drive and a selected one of a plurality of tubes penetrating through the heat exchanger tube sheet in order to feed the flexible lance into, through and back out of the selected tube.

An apparatus in accordance with the present disclosure may alternatively be viewed as an apparatus for positioning a flexible lance drive device in registry with an opening into a heat exchanger tube sheet. The apparatus incudes a flat plate bracket adapted to be bolted parallel to a flange of the heat exchanger adjacent the heat exchanger tube sheet so as to extend parallel to the flange. This bracket carries a stub tube fastened to and extending normal to the flat bracket, wherein the stub tube has a central axis and a plurality of lateral through bores intersecting the central axis. The apparatus also includes a rotary drive removably fastened to the stub tube and has a first air motor coupled through a worm gear to a rotary disc rotatable in a plane parallel to the tube sheet.

A slotted box rail having a proximal end clamped to the rotary disc of the rotary drive is rotated by the rotary drive. A linear drive assembly is removably fastened to the slotted box rail. This linear drive assembly includes a second air motor coupled to a drive sprocket configured to engage slots in the slotted box rail for movement of the linear drive assembly back and forth along the slotted rail.

The apparatus includes a guide tube collet block assembly clamped to the linear drive assembly, wherein the guide tube collet block assembly is configured to removably support a flexible lance drive and guide a flexible lance between the lance drive and a selected one of a plurality of tubes penetrating through the heat exchanger tube sheet in order to feed the flexible lance into, through and back out of the selected tube.

The flexible lance tractor drive in accordance with the present disclosure includes a generally rectangular box housing supported by the collet block. A pneumatic drive motor and gear box for driving the flexible lance are also supported on the housing. A tractor drive roller assembly and an idler roller assembly are carried within the rectangular box tractor drive housing. The idler roller may be separated from the drive roller via a sliding cam arrangement described in our U.S. Pat. No. 10,272,480 B2, granted Apr. 30, 2019, the content of which is incorporated herein by reference in its entirety.

An exemplary embodiment of an apparatus for positioning a flexible lance drive device in registry with an opening into a heat exchanger tube sheet in accordance with the present disclosure may be viewed as including a bracket adapted to be fixed directly to or adjacent to a heat exchanger tube sheet, the bracket carrying a stub tube fastened to and extending normal to the bracket. A rotary drive is removably fastened to the stub tube. The rotary drive has a first air motor coupled through a housing containing a worm gear to a rotary disc or top plate rotatable about the central axis in a plane parallel to the tube sheet. A slotted box rail has a proximal end clamped to the rotary disc of the rotary drive. A linear drive assembly is removably fastened to the slotted box rail. The linear drive assembly includes a second air motor coupled to a drive sprocket configured to engage slots in the slotted box rail for movement of the linear drive assembly back and forth along the slotted rail. A guide tube collet block assembly is clamped to the linear drive assembly, and is configured to removably support a flexible lance drive and guide a flexible lance between the lance drive and a selected one of a plurality of tubes penetrating through the heat exchanger tube sheet in order to feed the flexible lance into, through and back out of the selected tube. Each of the through bores in the stub tube is spaced 30 degrees apart from an adjacent through bore and the rotary drive has a tubular coupling adapted to fit over the stub tube and may be selectively fixed on the stub tube with a locking pin extending through the coupling and through an aligned stub tube through bore.

The rotary drive includes a slew drive housing carrying an annular worm gear fastened to the rotary disc or top plate rotatable about the central axis. The apparatus also includes a reduction gearbox fastening the first air motor to the slew drive housing. The rotary disc or top plate has a pair of parallel grooves in a surface thereof configured to receive and align the proximal end of the box rail to the rotary disc. The rotary drive housing has a cylindrical portion supporting the worm gear adjacent an open circular top opening of the housing. The rotary disc is a circular top plate fastened to the annular worm gear and closes the top opening of the cylindrical portion of the housing. The top plate has first and second parallel recessed grooves formed therein defining a diametric channel in the top plate extending across the top plate for receiving the proximal end of the slotted box rail therein. The rotary drive includes a rail retainer fastened to the top plate and extending over a portion of the first groove. An eccentric cam lever assembly is fastened to the top plate adjacent the second groove for removably clamping the box rail in the diametric channel formed in the top plate.

An embodiment alternatively may be viewed as a rotary drive assembly for use in an apparatus for positioning a flexible lance drive device in registry with an opening into a heat exchanger tube sheet. Such an embodiment may include a slew drive housing having a cylindrical portion supporting an annular worm gear therein adjacent a circular top opening and a circular top plate fastened to the annular worm gear. The circular top plate closes the top opening of the cylindrical portion of the housing. The circular top plate has first and second parallel recessed grooves in a top surface thereof defining a diametric channel in and extending across the top plate for receiving an end portion of a box rail therein. The assembly preferably includes a rail retainer fastened to the top plate extending over a portion of the first groove and an eccentric cam lever assembly fastened to the top plate adjacent the second groove, wherein the rail retainer and cam lever assembly cooperate to receive and hold the end of the box rail member in the diametric channel in the top plate.

This embodiment preferably further includes an air motor coupled through a reduction gear assembly to a worm contained within the slew drive housing operably coupled to the annular worm gear. The reduction gear assembly includes a gearbox housing fastened to the slew drive housing containing a plurality of meshed spur gears coupled to the worm. The rotary drive assembly further includes a bottom member fastened to a bottom of the slew drive housing. This bottom member has a circular flange portion and a tubular portion extending from the flange portion. The bottom member is fastened to the rotary drive housing via bolts. The bottom member has a circular flange portion and a tubular portion extending from the flange portion. This tubular portion fits over the stub tube fastening the rotary drive to the support bracket. The tubular portion of the bottom member has a pair of diametrically opposite lateral bores therethrough configured to align with one or more of the stub tube through bores. A locking pin is preferably inserted through a set of matching bores to fix the rotary drive to the support bracket fastened to the tube sheet of the heat exchanger to be cleaned.

Further features, advantages and characteristics of the embodiments of this disclosure will be apparent from reading the following detailed description when taken in conjunction with the drawing figures.

DETAILED DESCRIPTION

Figure 1:
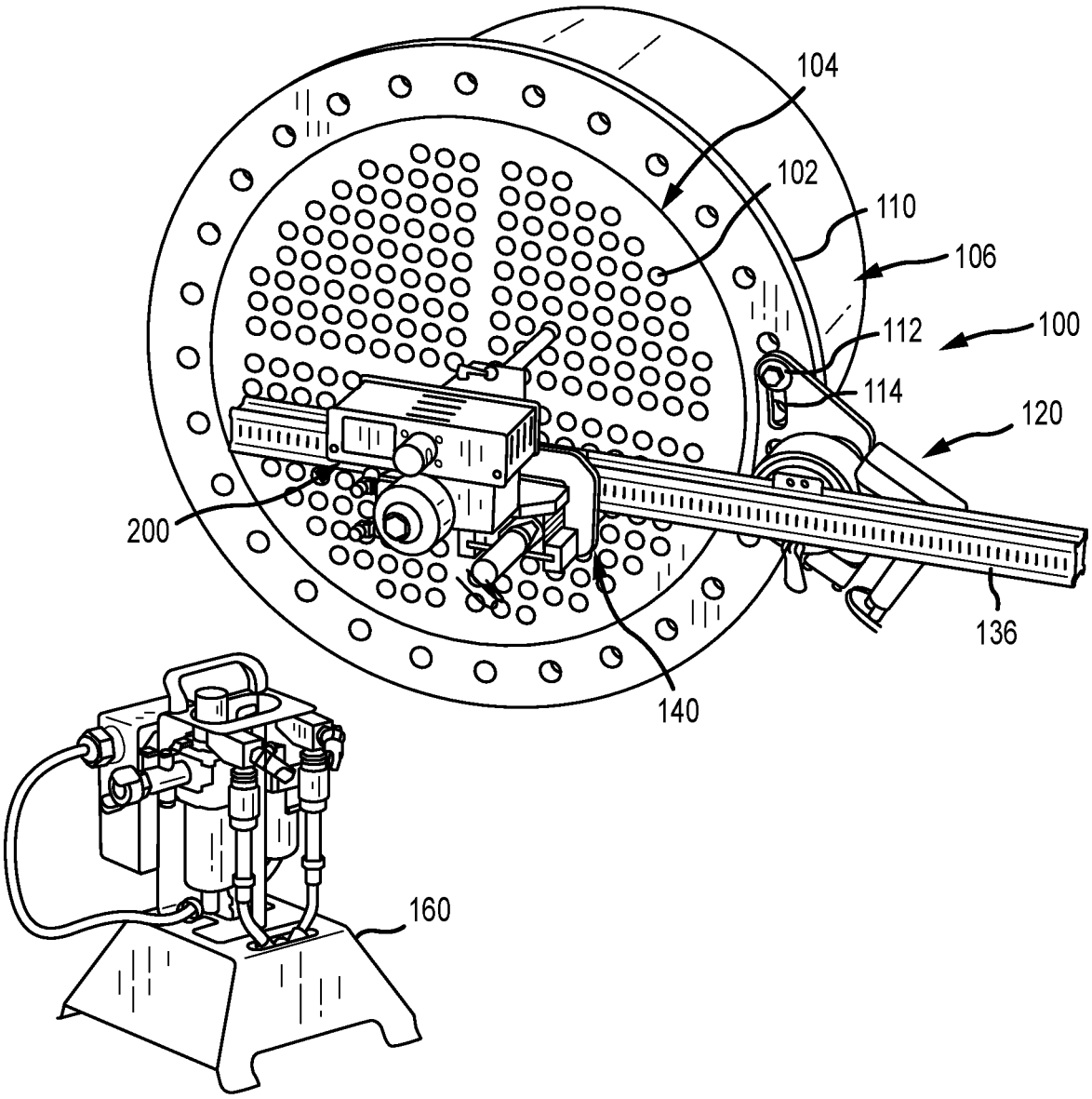
FIG. 1 is a perspective view of an apparatus according to the present disclosure mounted to a heat exchanger tube sheet flange.

An exemplary embodiment of an apparatus 100 in accordance with the present disclosure is shown in FIG. 1 for positioning a flexible lance tractor drive device 200 in registry with a tube 102 penetrating a tube sheet 104 of a heat exchanger 106. The apparatus 100 includes a flat plate bracket 108 that is bolted to the tube sheet flange 110 via a couple of bolts 112. This plate bracket 108 is preferably a curved trapezoidal shaped plate with spaced slots 114 along its large side so as to correspond to bolt holes in various sizes of tube sheet flanges.

Figure 3:
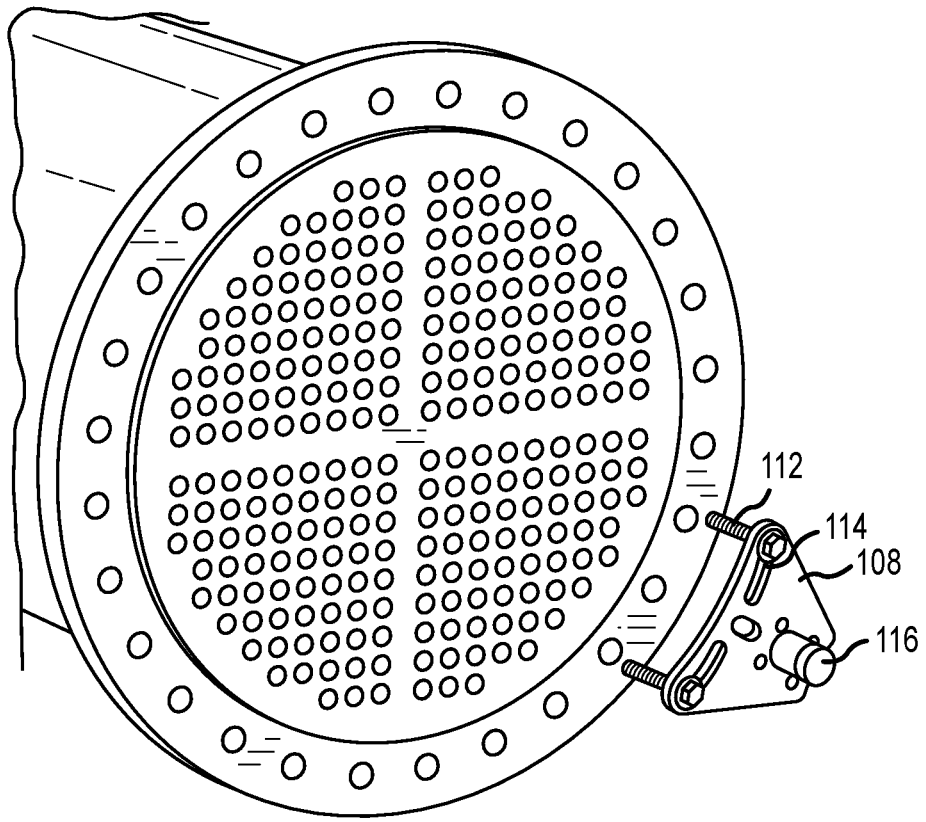
FIG. 3. Is a partially exploded view of the mounting bracket adjacent a heat exchanger tube sheet.

This plate bracket 108 has a mounting stub tube 116 fastened thereto that extends normal to the plate bracket 108. The stub tube 116, visible in FIG. 3, has a central axis and a series of lateral through bores 118 that intersect the central axis of the stub tube 116. Preferably there are 6 or 8 through bores 118 spaced around the circumference of the stub tube 116. For example, there may be 6 bores spaced 30 degrees apart.

Figure 4:
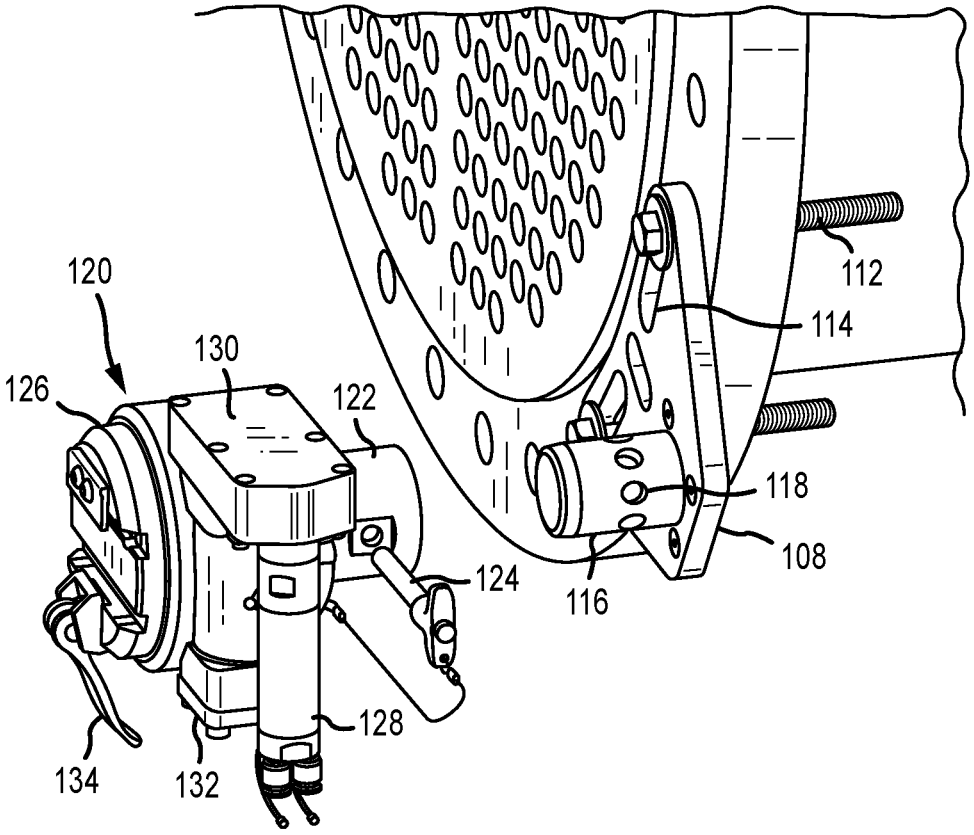
FIG. 4 is a perspective view of the rotary drive assembly according to the present disclosure spaced from the stub tube.
Figure 5:
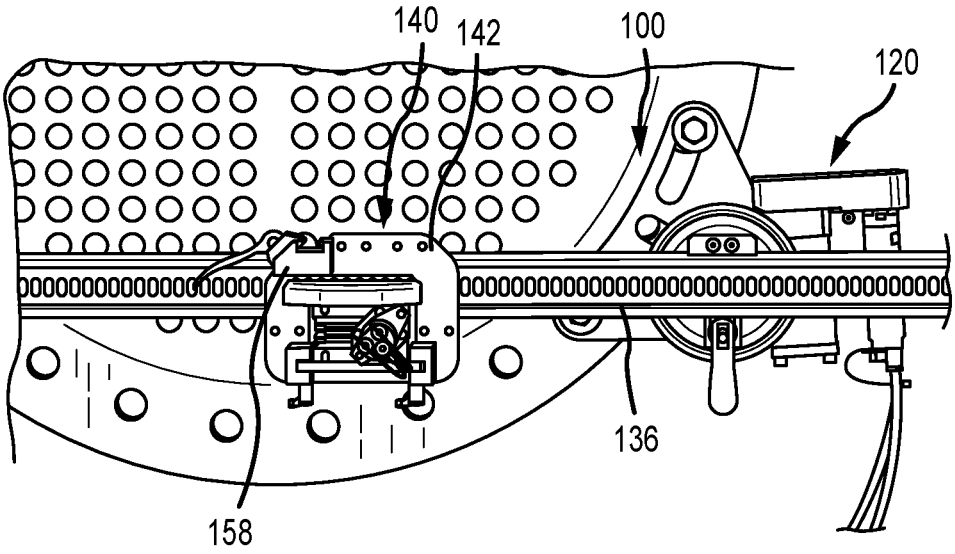
FIG. 5 is a plan view of the linear drive fastened to the box rail over the tube sheet shown in FIG. 1.
Figure 6:
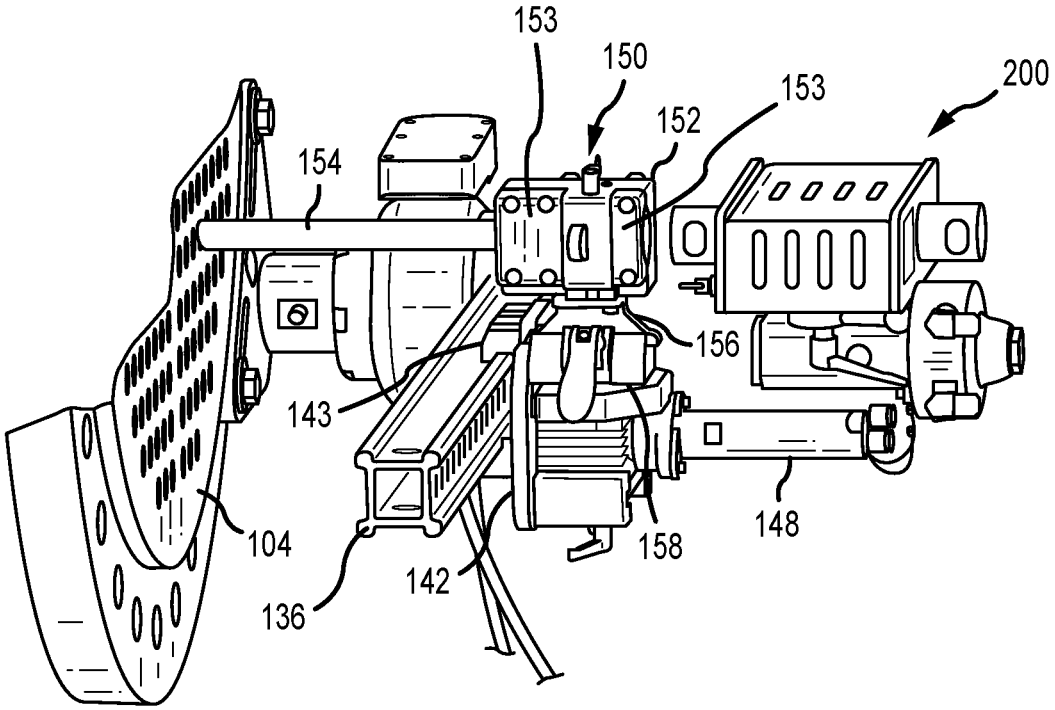
FIG. 6 is a perspective view of the apparatus according to the disclosure with the tractor drive device aligned for fastening to the guide tube collet assembly.

A rotary drive 120 is removably fastened to the stub tube 116 via a tubular coupling sleeve 122 that is pinned to the stub tube 116 via a locking pin 124 passing through the coupling sleeve 122 and one set of the through bores 118, as shown in FIG. 4. This arrangement permits the rotary drive to be fixed in place adjacent the tube sheet 104 at different angular positions with respect to the tube sheet 104 and held in place with the locking pin 124.

The rotary drive carries a rotatable disc 126 that is rotated by a first air motor 128 operating through a reduction gear set 130 and annular worm gear 132. The rotary drive can rotate the disc 126 to any angular position about the stub tube 116. The rotatable disc 126 has a manual cam clamp 134 and cleat that removably captures a proximal end of a slotted box rail 136 to the rotatable disc 126 as is shown in FIG. 1. The rotary drive 120, operated via the first air motor 128 is configured to rotate the box rail 136 in a plane parallel to and spaced from the tube sheet 104.

A linear drive assembly 140 is movably fastened to the box rail 136 and is shown in FIGS. 5-10. This linear drive assembly 140 has a carriage plate 142 to which are fastened at least one pair of opposed rail slides 143 which engage raised corners of the box rail 136 to permit the carriage plate 142 to ride on the box rail 136. The drive assembly 140 also has a drive sprocket 146 rotatably mounted to the carriage plate 142 that is operated by a second air motor 148. This drive sprocket 146 engages the ladder type slots in the slotted box rail 136 to position the linear drive assembly 140 at any desired position along the box rail 136.

Figure 8:
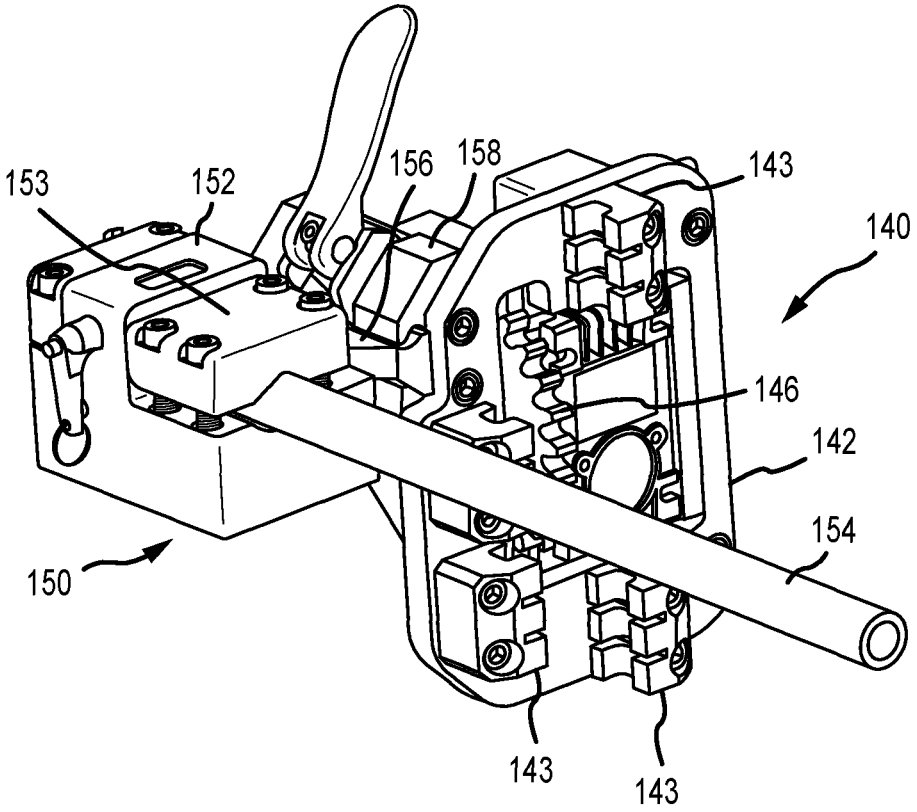
FIG. 8 is a perspective separate underside view of the linear drive in the apparatuses shown in FIGS. 1-7.
Figure 9:
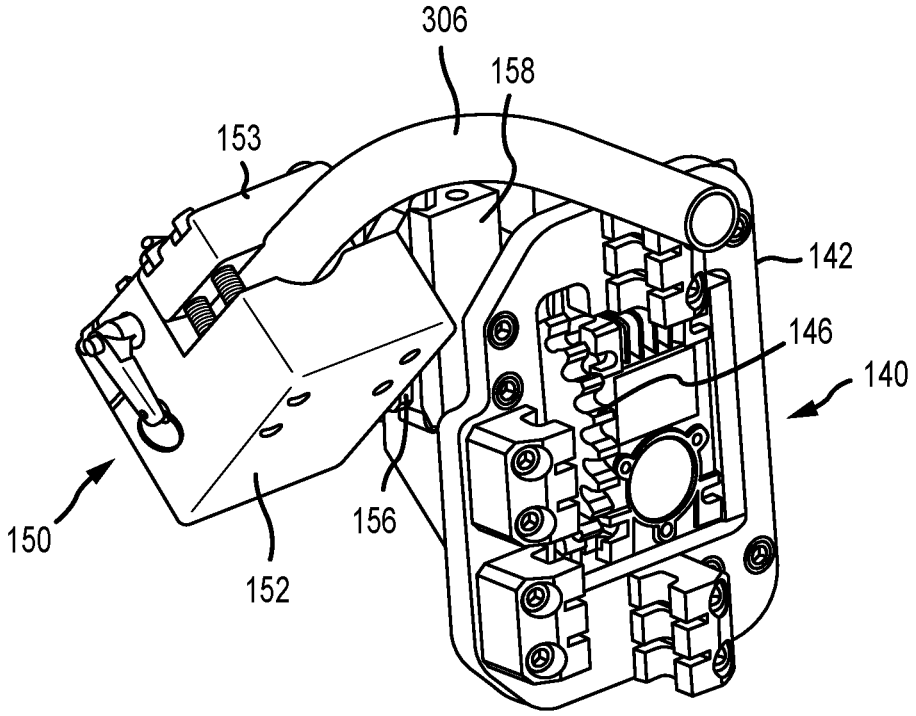
FIG. 9 is a perspective underside view of the linear drive in the apparatus shown in FIG. 7 with the collet block fastened to the base plate at a 45 degree angle supporting a 45 degree guide tube.
Figure 10:
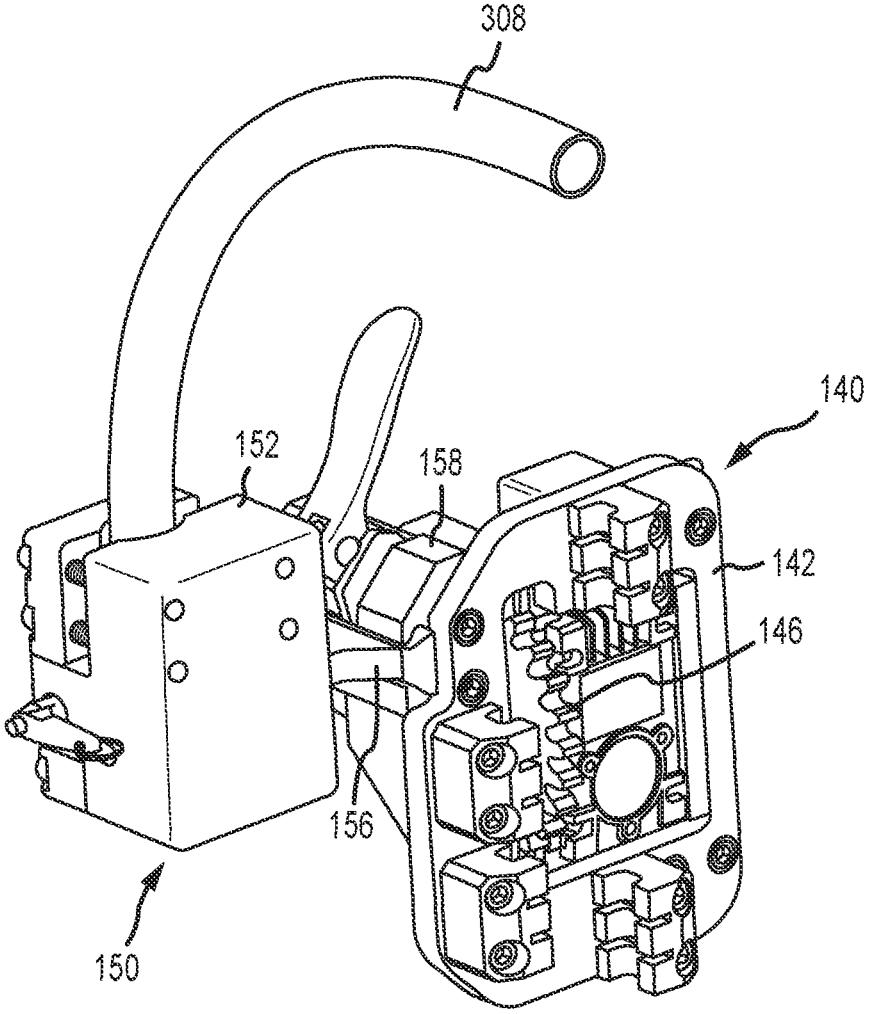
FIG. 10 is a perspective underside view of the linear drive in the apparatus shown in FIG. 7 with the collet block fastened to the base plate at a 90 degree angle supporting a 90 degree guide tube.

Fastened to the linear drive assembly 140 is a tractor guide tube collet block assembly 150, separately shown in FIGS. 8, 9 and 10. This guide tube collet block assembly 150 includes a rectangular collet block 152 and is fastened to one end of an elongated guide tube 154 which has its other end positioned close to but not touching the tube sheet 104. The collet block assembly 150 has a dovetail slide 156 fastened to one side of the rectangular collet block 152. This dovetail slide 156 is adapted to fit within a complementary slot in a clamp block 158 fastened to the carriage plate 142 of the linear drive assembly 140 to hold the guide tube collet block assembly 150 firmly to the carriage plate 142 of the linear drive assembly 140. The guide tube 154 is preferably removably fastened to the collet block 152 via a bolted collet block cap 153.

Figure 2:
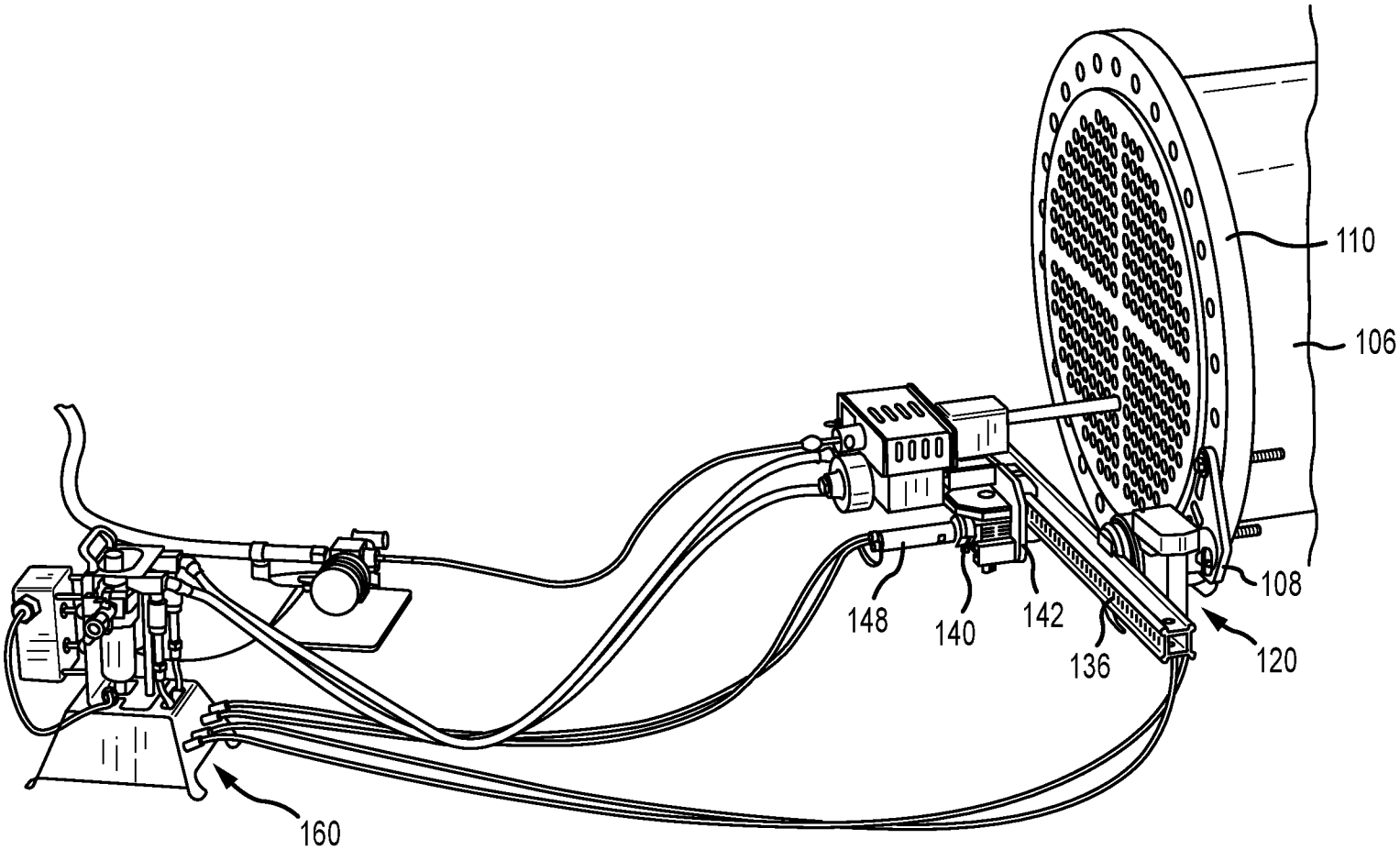
FIG. 2 is a perspective view of the apparatus shown in FIG. 1 including the control box and air hoses.

The collet block 152 is configured to removably support a flexible lance drive 200 thereto as shown in FIGS. 1 and 2. The lance drive 200 is configured to guide and drive a flexible lance between the lance drive 200 and a selected one of a plurality of tubes 102 penetrating through the heat exchanger tube sheet 104. In this manner the flexible lance is fed into, through and back out of the selected tube 102.

The apparatus 100 further preferably includes a control station 160 which is configured to be remotely positioned from the rotary drive 120 fastened to the tube sheet 104 by a suitable distance to permit an operator to operate the apparatus 100 without undue exposure to fluid spray. Typically the control station 160 is positioned on a floor and spaced perhaps 20 feet from the tube sheet 104. Air hoses (not shown) connect the control station to the first and second air motors 128 and 148 in a conventional manner.

This control station 160 includes a control air pressure regulator, an inline oiler and a removable tethered remote box to permit an operator to move away from the control station while controlling lance feed rate of the flexible lance, rotation of the box rail 136 via the first air motor 128 on the rotary plate 126 and linear position of the collet block 152 and guide tube 154 along the box rail 136 via the second air motor 148. The flexible lance tractor drive 200 is described in detail U.S. Pat. No. 10,272,480 B2, mentioned previously.

An alternative configuration of an apparatus 300 in accordance with the present disclosure is shown in FIGS. 7 through 10 in which the apparatus 300 is fastened directly to the tube sheet 104 via expansion bolts 302 installed in two or more tubes 102 and engaging the sidewalls of the tubes 102 to fix the apparatus 300 in place. The flat plate bracket 108 may have any desired flat shape and may be the same bracket 108 shown in FIG. 1 which is preferably a curved trapezoidal shaped flat plate with spaced slots 114 along its large side so as to correspond to bolt holes in various sizes of tube sheet flanges, except, in this embodiment 300, the bracket 108 is fastened directly to the tube sheet 104.

This plate bracket 108 has a mounting stub tube 116 fastened thereto that extends normal to the plate bracket 108. The stub tube 116, visible in FIG. 3, has a central axis and a series of lateral through bores 118 that intersect the central axis of the stub tube 116. Preferably there are 6 or 8 through bores 118 spaced around the circumference of the stub tube 116. For example, there may be 6 bores spaced 30 degrees apart.

A rotary drive 120 is removably fastened to the stub tube 116 via a tubular coupling sleeve 122 that is pinned to the stub tube 116 via a locking pin 124 passing through the coupling sleeve 122 and one set of the through bores 118, as shown in FIG. 4. This arrangement permits the rotary drive to be fixed in place adjacent the tube sheet 104 at different angular positions with respect to the tube sheet 104 and held in place with the locking pin 124.

Figure 7:
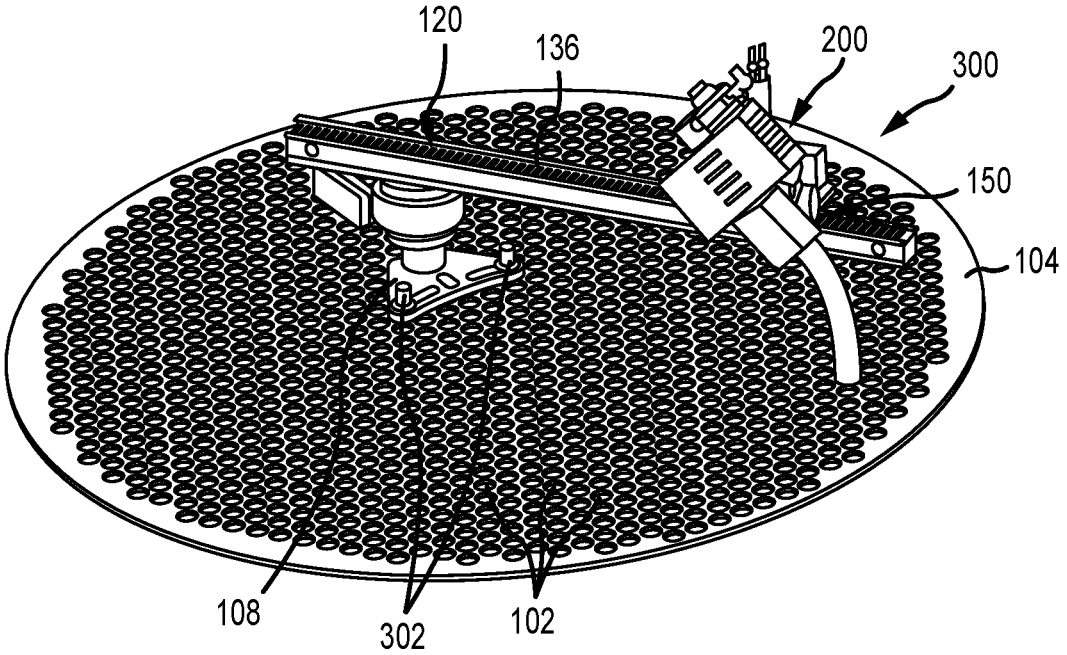
FIG. 7 is a perspective view of an alternative apparatus according to the present disclosure mounted directly to a heat exchanger tube sheet rather than the flange.

The rotary drive 120 carries a rotatable disc 126 that is rotated by a first air motor 128 operating through a reduction gear set 130 and worm gear 132. The rotary drive can rotate the disc 126 to any angular position about the stub tube 116. The rotatable disc 126 has a manual cam clamp 134 and cleat that removably captures a portion of a slotted box rail 136 to the rotatable disc 126 as is shown in FIG. 7. The rotary drive 120, operated via the first air motor 128 is configured to rotate the box rail 136 in a plane parallel to and spaced from the tube sheet 104.

A linear drive assembly 140 is movably fastened to the box rail 136. This linear drive assembly 140 has a carriage plate 142 to which are fastened a pair of opposed rail slides which engage raised corners of the box rail 136 to permit the carriage plate 142 to ride on the box rail 136. The drive assembly 140 also has a drive sprocket 146 rotatably mounted to the carriage plate 142 that is operated by a second air motor 148. This drive sprocket 146 engages the ladder type slots in the slotted box rail 136 to position the linear drive assembly 140 at any desired position along the box rail 136.

Fastened to the linear drive assembly 140 is a tractor guide tube collet block assembly 150. This guide tube collet block assembly 150 includes a rectangular collet block 152 and is fastened to one end of an elongated guide tube 154 which has its other end positioned close to but not touching the tube sheet 104. In the embodiment 300 shown in FIG. 7, the guide tube 154 is straight. In the embodiments shown in FIGS. 7, 9 and 10, the guide tube 154 is curved. The collet block assembly 150 has a dovetail slide 156 fastened to one side of the rectangular collet block 152. This dovetail slide 156 is adapted to fit within a complementary slot in a clamp block 158 fastened to the carriage plate 142 of the linear drive assembly 140 to hold the guide tube collet block assembly 150 firmly to the carriage plate 142 of the linear drive assembly 140. The guide tube 154 is preferably removably fastened to the collet block 152 via a bolted collet block cap 153.

The collet block 152 is configured to removably support a flexible lance drive 200 thereto. The lance drive 200 is configured to guide and drive a flexible lance between the lance drive 200 and a selected one of a plurality of tubes 102 penetrating through the heat exchanger tube sheet 104. In this manner the flexible lance is fed into, through and back out of the selected tube 102.

FIG. 8 is a separate perspective view of the guide tube collet block assembly 150 shown in FIGS. 1-6. The collet block 152 is fastened to the elongated straight guide tube 154. The dovetail slide 156 fastens the collet block 152 to the carriage plate 142 via a clamp block 158.

FIG. 9 shows a perspective view of a first alternative configuration of the guide tube collet block assembly 150 in which the clamp block 158 is rotated 90 degrees on the carriage plate 142. In addition, the dovetail slide 156 fastened to the collet block 152 is rotated 45 degrees from that shown in FIG. 8. In FIG. 9, a 45 degree bent guide tube 306 is fastened to the collet block 152. In this configuration, the drive 200 will be mounted to the guide tube collet block assembly 150 at an angle of about 45 degrees from vertical permitting the assembly 300 to be mounted inside the end dome (not shown) of the heat exchanger or otherwise where maneuvering space is limited to the width of the tube sheet 104. Alternatively the collet block 152 and/or the clamp block 158 may be mounted to the carriage plate 142 such that the drive 200 may be mounted at an angle of about 30 or 60 degrees from vertical such that a different angled guide tube may be utilized as may be appropriate to a confined head space available aligned with or around the tube sheet 104.

FIG. 10 shows a perspective underside view of the guide tube collet block assembly 150 in which the clamp block 158 is further rotated so as to be at 90 degrees from that shown in FIG. 8. In this configuration, a right angle guide tube 308 is fastened to the collet block 152.

Figure 11:
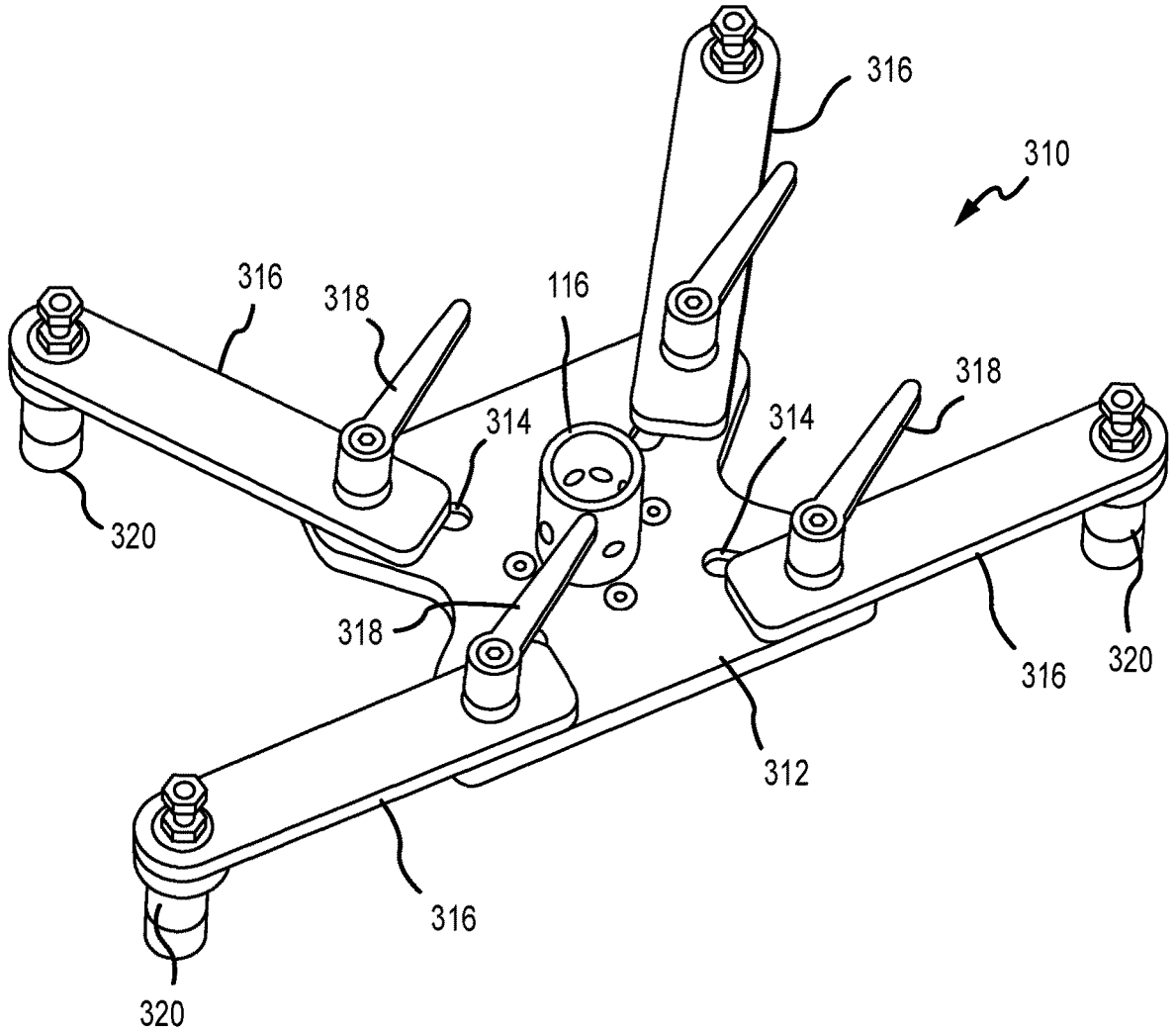
FIG. 11 is a perspective view of an alternative mounting bracket configured for fastening the apparatus directly to a heat exchanger tube sheet.

FIG. 11 is a perspective view of an adjustable bracket 310 for fastening the stub tube 116 of the apparatus 300 to the tube sheet 104. This bracket 310 has a flat base plate 312 with a slot 314 radially spaced from each corner of the plate 312. In this illustrated embodiment 310, there are four corners and hence four slots 314. A link member 316 has its proximal end fastened in each one of the slots 314 via a rotary clamp 318. The distal end of each link member 316 is fastened to an expansion plug 320 that fits down into one of the heat exchanger tubes in the tube sheet 104. As the expansion plug 320 is tightened, the plug expands to frictionally hold the plug in place. When the rotary clamps 318 are loosened, the plate 312 may be moved within a circular region of the tube sheet 104 defined by the interaction of the link members 316 in the slots 314. When the clamps 318 are tightened, the stub tube 116 is fixed in a desired position with respect to the tube sheet 104.

Many changes may be made to any one of the apparatus 100 or 300, which will become apparent to a reader of this disclosure. For example, the box rail 136 may be a slotted I beam or other configuration. The air motors could be replaced with electrical stepper motors or other electrical motor types. The manual cam clamps could be replaced by bolted connections. Alternative to the configurations shown in FIGS. 7-10, the clamp block 158 could be fastened to a rotatable disc (not shown) fastened to the carriage plate 142 such that the collet block 152 may be oriented at any desired angle. The adjustable bracket 310 may alternately be configured to be attached to a steel tube sheet 104 via magnets instead of the expansion plugs 320. The box rail 136 may be formed from mechanically spliceable rail segments that are joined by internal box shaped splices (not shown) so that a variety of installation configurations can be accommodated.

Figure 12:
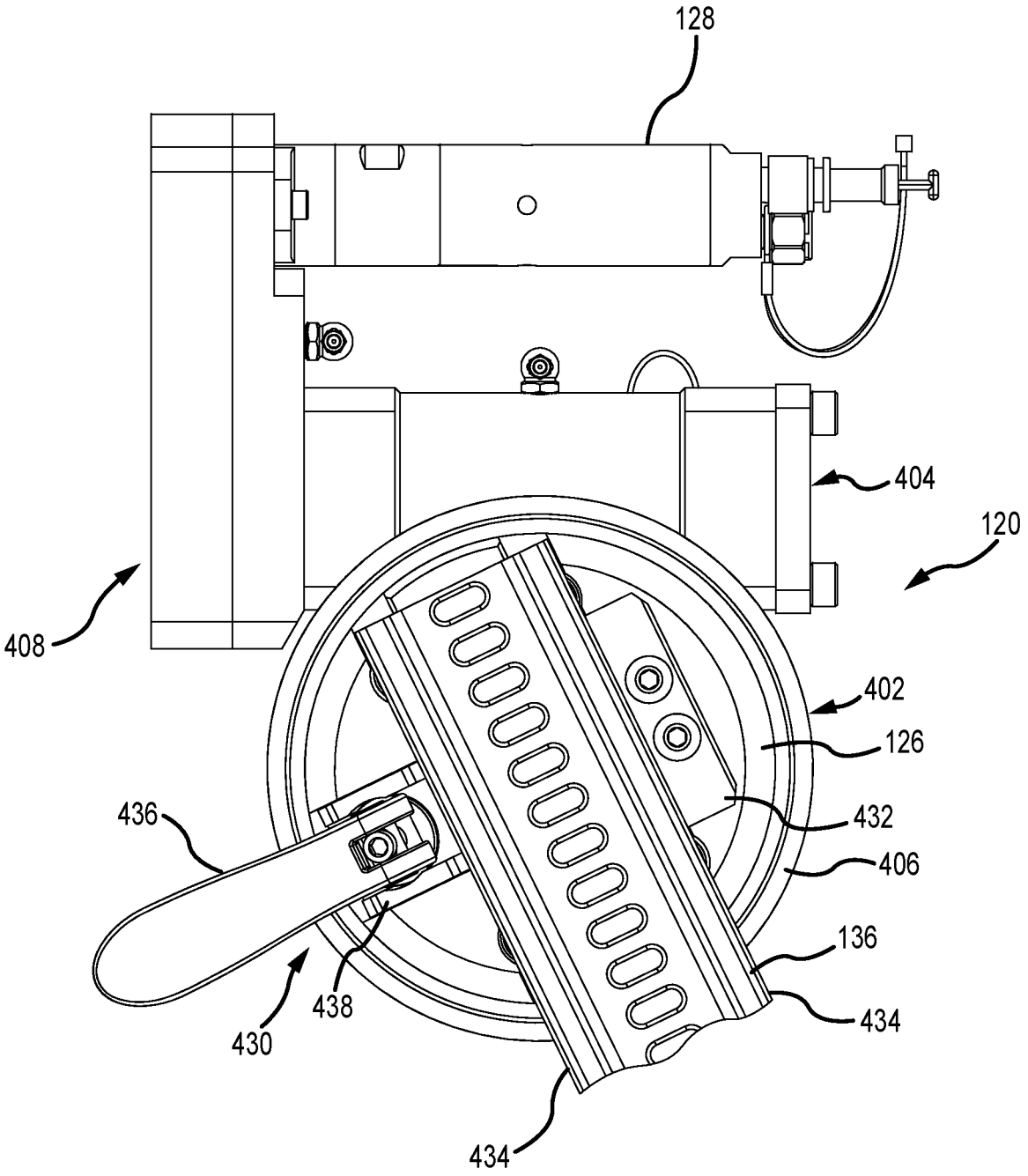
FIG. 12 is a top close-up view of the rotary drive assembly shown in FIG. 4.
Figure 13:
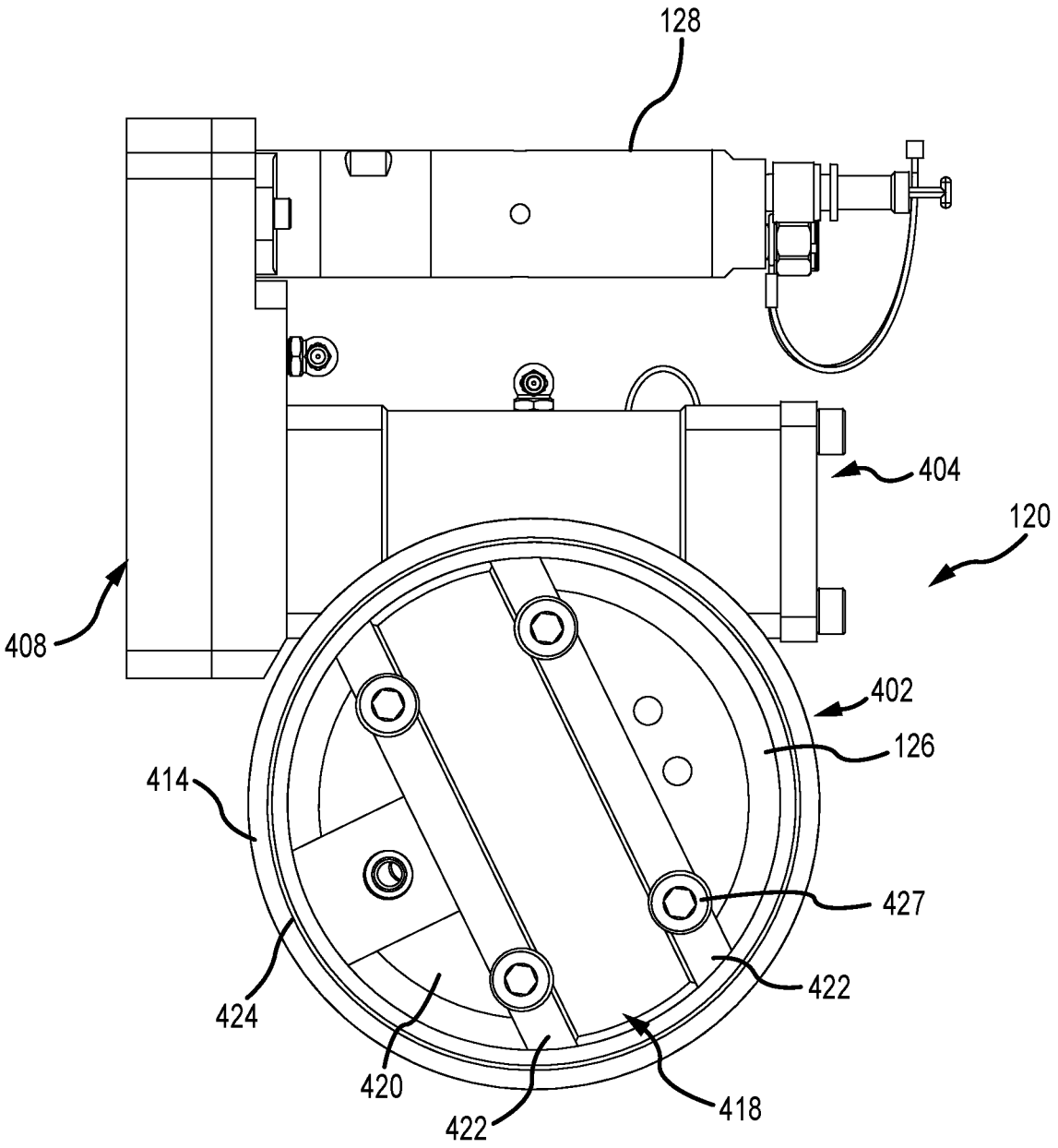
FIG. 13 is a top close-up view of the rotary drive assembly shown in FIG. 12 with the box rail and rail clamp assembly removed.
Figure 14:
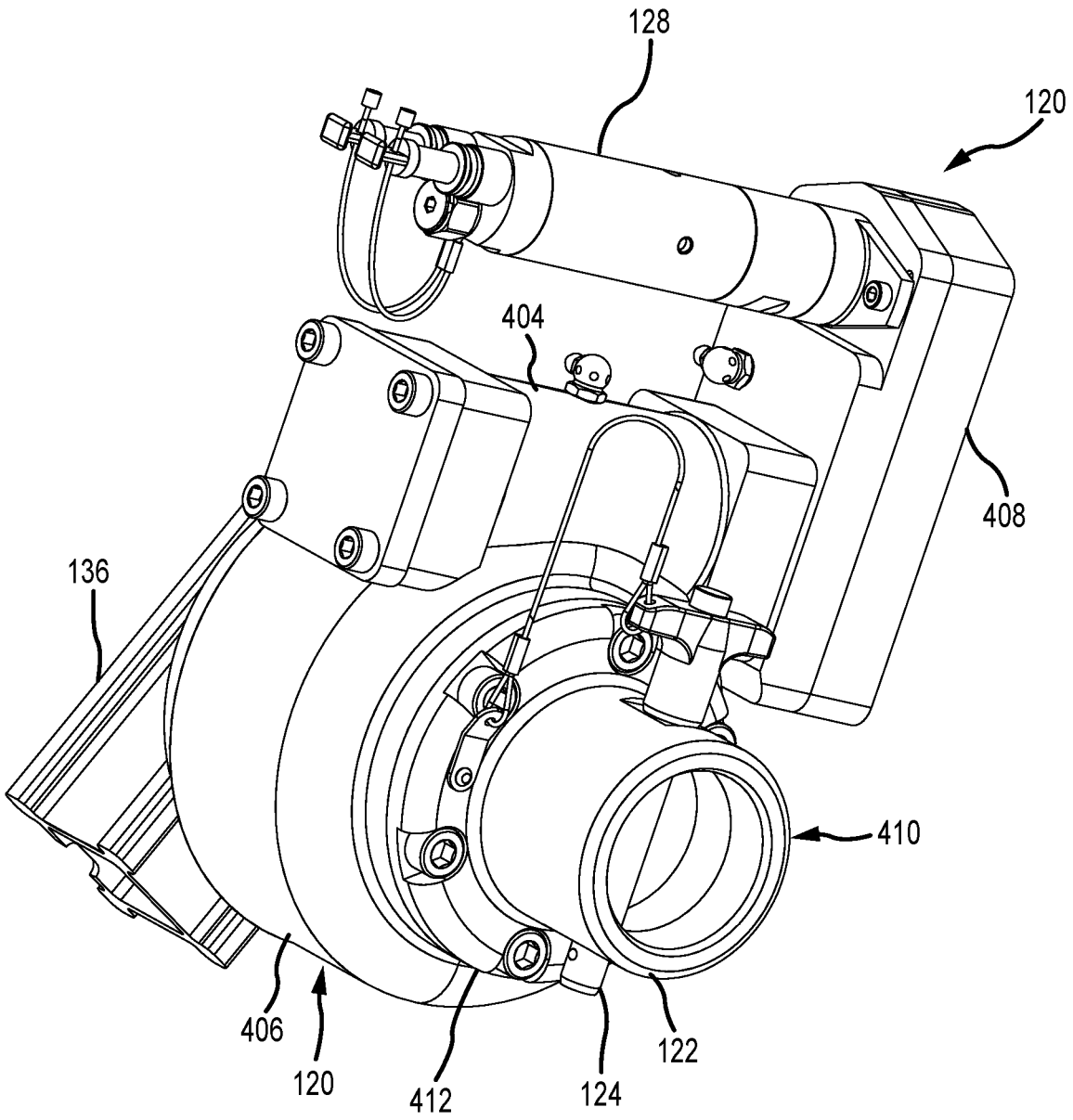
FIG. 14 is a bottom perspective view of the rotary drive assembly shown in FIG. 12.
Figure 15:
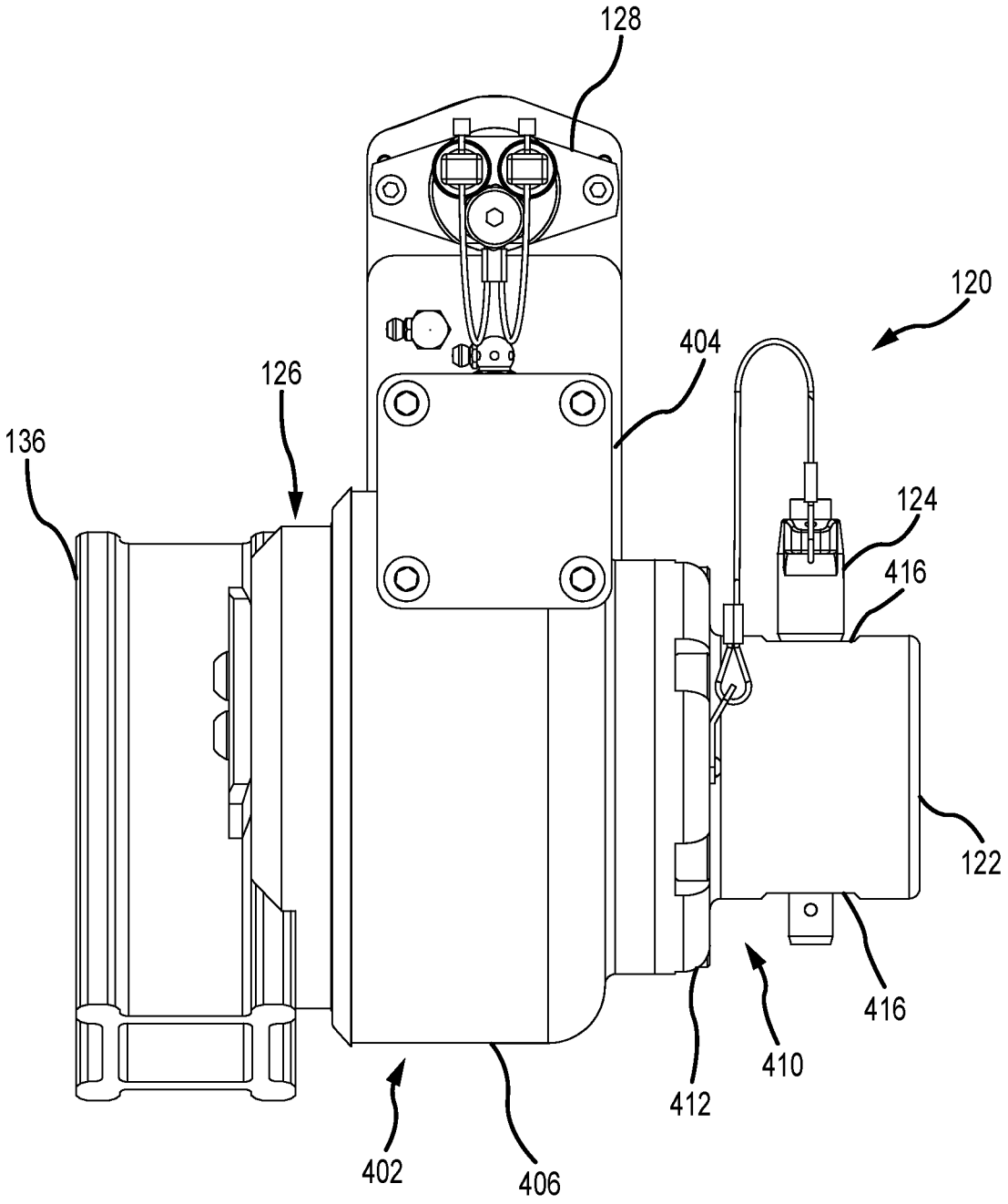
FIG. 15 is a left side view of the rotary drive assembly shown in FIG. 12.
Figure 16:
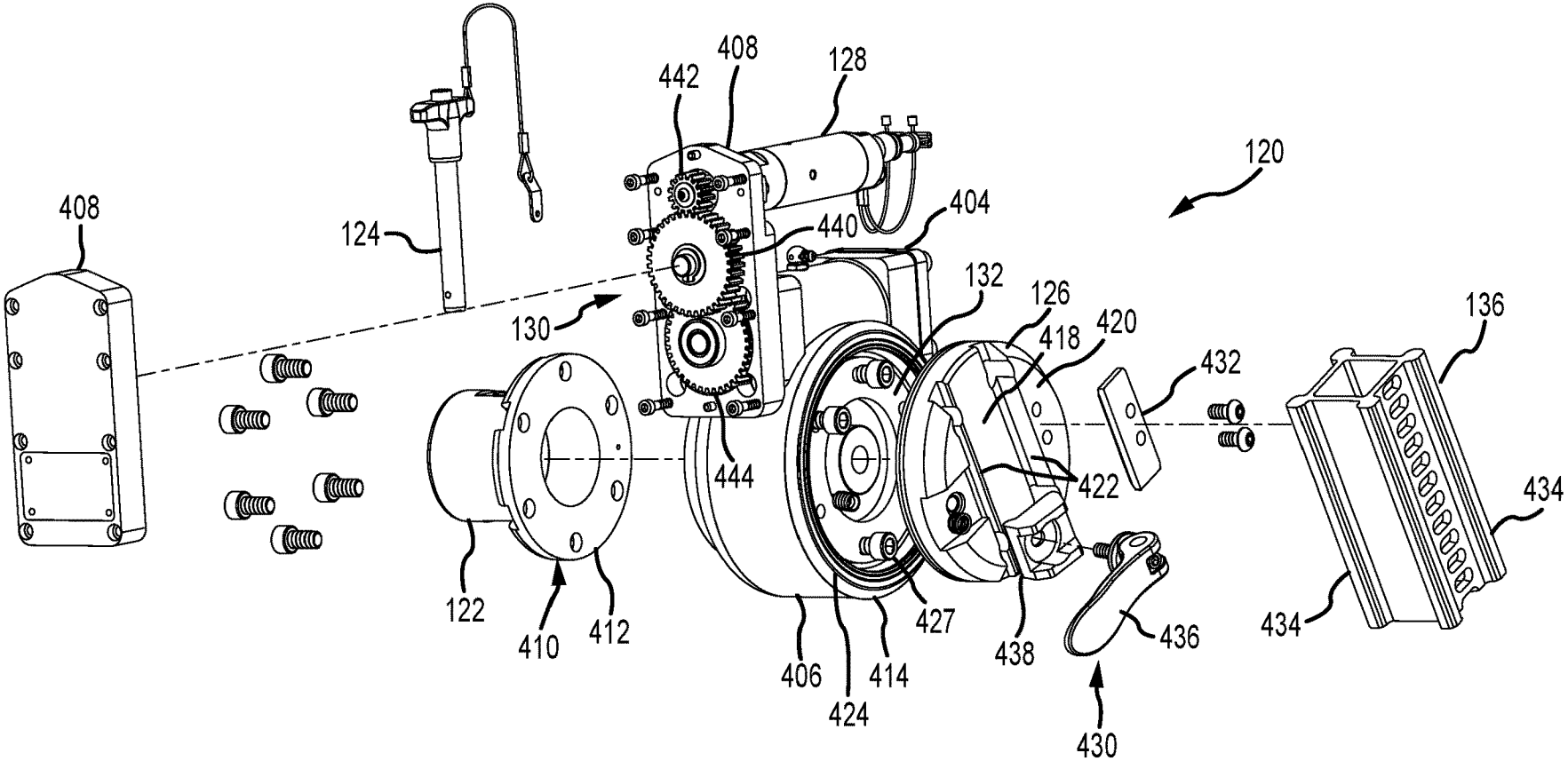
FIG. 16 is an exploded view of the rotary drive assembly shown in FIG. 12.

The rotary drive assembly 120 is shown separately in FIGS. 12 through 16. A separate top or plan view of the complete rotary drive assembly 120 is shown in FIG. 12. An exploded view is shown in FIG. 16. A separate top view is shown in FIG. 13 without the box rail 136 and box rail clamp assembly 430 installed. Turning now specifically to FIG. 12, the assembly 120 basically includes a slew drive housing 402 having a worm portion 404 fastened to the side of a cylindrical pancake shaped worm gear portion 406, a reduction gearbox 408 fastened to the worm portion 404, an air motor 128 fastened to the reduction gearbox 408 and a rail clamp assembly 430 attached to a top plate or disc 126 attached to the worm gear 132 (FIG. 16) and closing the worm gear portion 406 of the slew drive housing 402. This rotary slew drive 120 configuration is compact, resulting in a small footprint when mounted on or adjacent the tube sheet 104

A bottom member 410, best seen in FIGS. 15 and 16, is bolted to the bottom of the cylindrical worm gear portion 406 of the slew drive housing 402. This bottom member 410 has a circular flange portion 412 and a central tubular sleeve 122 extending from the circular flange portion 412. The flange portion 412 is fastened directly to the bottom of the cylindrical worm gear portion 406 of the slew drive housing 402.

The tubular sleeve 122 of the bottom member 410 is sized to slip over and down onto the stub tube 116 of the bracket 108. The sleeve 122 of the bottom member 410 has a pair of diametrically opposite lateral bores 416 therethrough which align with a pair of lateral bores 118 through the stub tube 116 above described. A locking pin 124 is pushed through the lateral bores 416 and through a set of the stub tube bores 118 to lock rotary position of the slew drive housing 402 in any one of six positions around the stub tube axis.

The cylindrical worm gear portion 406 of the slew drive housing 402 has an open circular end 414 exposing the annular worm gear 132 just below a circular rim 414 of the cylindrical portion 406. A circular top plate or disc 126 is bolted to the worm gear 132 and substantially closes the open end 414 of the cylindrical worm gear portion 406 of the slew drive housing 402.

This circular top plate 126 is unique and clearly shown in FIG. 13. It has a central diametric flat bottomed channel 418 formed in the upper surface 420 of the top plate 126. This central channel 418 is defined in part by two parallel grooves 422 cut into and across the upper surface 420 of the top plate 126 equidistant from the center of the top plate 126. The combination of the channel 418 and parallel grooves 422 together is sized to receive one side of the box rail 136 such that the rail 136, when fastened to the top plate 126, closely clears the rim 424 of the open end 414 of the worm gear cylindrical portion 406 of the slew drive housing 402. The upper side of the annular worm gear 132 facing the opening 414 has six threaded holes 426 spaced therearound. The top plate 126 is bolted to the worm gear 132, visible in the exploded view of FIG. 16, via four bolts 427 recessed beneath the grooves 422. These grooves 422 are oriented in the top plate 126 such that a box rail 136 fastened in the channel 418 will closely clear the rim 424 of the open circular end 414 of the worm gear portion 406 of the slew drive housing 402 and is rigidly captured by and between the grooves 422 within channel 418.

Attached to the top plate 126, as shown in FIGS. 12, 14 and 15, is a box rail 136 via a box rail clamp assembly 430. This box rail clamp assembly 430 includes a rectangular rail retainer bracket 432 fastened to the top plate 126 adjacent one of the grooves 422 such that part of the bracket 432 extends over a corner bead 434 of the rail 136 as shown in FIG. 12. On the other side of the channel an over center eccentric clamp lever 436 and rocker plate 438 is bolted to the top plate 126. The rocker plate 438 has a portion that extends over an opposite corner bead 434 of the rail 136 and a portion of the opposite corner bead 434 that lies beneath the rocker plate 438 under the eccentric clamp lever 436 such that when the clamp lever 436 is rotated downward, the rocker plate 438 draws the box rail 136 further into the channel 418 to removably secure the box rail 136 to the top plate 126. When the clamp lever 436 is raised, i.e. loosened, the box rail 136 may slide along the channel 418 to adjust its position on the top plate 126 and the clamp lever 436 retightened to securely position the box rail 136 to the top plate 126. This arrangement permits the box rail 136 to be rotated accurately about the end of the slew drive housing 402 as an extension of the worm gear 132.

The reduction gearbox 408 attached to the worm portion 404 of the slew drive housing 402 contains gear set 130, visible in FIG. 16. Gear set 130 incudes a series of spur gears 440 rotatably fastened within the gearbox 408 such that the pinion gear 442 of the air motor 128 attached to the gearbox 408 rotates much faster than the spur gear 444 attached to the distal end of the worm housed in worm portion 404 of the slew drive housing 402. The spur gear reduction in one exemplary embodiment is about 4.44:1. This spur gear reduction combined with the slewing gearbox reduction of 62:1 provides a controllable rotation speed with minimal backlash, so that the air motor 128 can precisely rotate the box rail 136 in either direction with minimal overshoot. Other gear reduction ratios may be chosen to optimize performance on longer or shorter rail lengths.

Many changes may be made to the embodiments described herein that will be clearly apparent to a person skilled in the art reading this disclosure. All such changes, alternatives and equivalents in accordance with the features and benefits described herein, are within the scope of the present disclosure. Any or all of such changes and alternatives may be introduced without departing from the spirit and broad scope of my disclosure and invention as defined by the claims below and their equivalents.

What is claimed is:

1. An apparatus for positioning a flexible lance drive device in registry with an opening into a heat exchanger tube sheet, the apparatus comprising:

a flat bracket adapted to be fixed directly to or adjacent to a heat exchanger tube sheet, the bracket carrying a stub tube fastened to and extending normal to the flat bracket, wherein the stub tube has a central axis and a plurality of lateral through bores intersecting the central axis;

a rotary drive removably fastened to the stub tube, the rotary drive having a first air motor coupled through a worm gear to a rotary disc rotatable about the central axis in a plane parallel to the tube sheet;

a slotted box rail having a proximal end clamped to the rotary disc of the rotary drive; and a linear drive assembly removably fastened to the slotted box rail, the linear drive assembly including a second air motor coupled to a drive sprocket configured to engage slots in the slotted box rail for movement of the linear drive assembly back and forth along the slotted box rail; and a guide tube collet block assembly clamped to the linear drive assembly, wherein the guide tube collet block assembly is configured to removably support flexible lance drive device and guide a flexible lance between the flexible lance drive device and a selected one of a plurality of tubes penetrating through the heat exchanger tube sheet in order to feed the flexible lance into, through and back out of the selected tube.

2. The apparatus according to claim 1 wherein each of the through bores in the stub tube is spaced 30 degrees apart from an adjacent through bore and the rotary drive has a tubular coupling adapted to fit over the stub tube and may be selectively fixed on the stub tube with a locking pin extending through the coupling and through an aligned stub tube through bore.

3. The apparatus according to claim 1 wherein the rotary drive includes a slew drive housing carrying a worm gear fastened to the rotary disc rotatable about the central axis.

4. The apparatus according to claim 3 further comprising a reduction gearbox fastening the first air motor to the slew drive housing.

5. The apparatus according to claim 3 wherein the rotary disc has a pair of parallel grooves in a surface thereof configured to receive and align the proximal end of the slotted box rail to the rotary disc.

6. The apparatus according to claim 1 wherein the rotary drive includes a housing that has a cylindrical portion supporting the worm gear adjacent an open circular top opening and the rotary disc is a circular top plate fastened to the worm gear and closing the top opening of the cylindrical portion of the housing, wherein the top plate has first and second parallel recessed grooves formed therein defining a diametric channel in the top plate extending across the top plate for receiving the proximal end of the slotted box rail therein.

7. The apparatus according to claim 6 wherein the rotary drive includes a rail retainer fastened to the circular top plate and extending over a portion of the first groove.

8. The apparatus according to claim 7 further comprising an eccentric cam lever assembly fastened to the circular top plate adjacent the second groove for removably clamping the slotted box rail in the diametric channel.

9. A rotary drive for use in an apparatus for positioning a flexible lance drive device in registry with an opening into a heat exchanger tube sheet, the rotary drive comprising:

a slew drive housing having a cylindrical portion supporting an annular worm gear therein adjacent a circular top opening and a circular top plate fastened to the annular worm gear, the circular top plate closing the top opening of the cylindrical portion of the slew drive housing, wherein the circular top plate has first and second parallel recessed grooves therein defining a diametric channel in and extending across the circular top plate for receiving an end portion of a box rail therein;

a rail retainer fastened to the top plate extending over a portion of the first groove; and an eccentric cam lever assembly fastened to the top plate adjacent the second groove, wherein the rail retainer and cam lever assembly cooperate to receive and hold the end of the box rail in the diametric channel in the circular top plate.

10. The rotary drive according to claim 9 further comprising an air motor coupled through a reduction gear assembly to a worm contained within the slew drive housing operably coupled to the annular worm gear.

11. The rotary drive according to claim 10 wherein the reduction gear assembly includes a gearbox housing fastened to the slew drive housing containing a plurality of meshed spur gears coupled to the worm.

12. The rotary drive according to claim 9 further comprising a bottom member fastened to a bottom of the slew drive housing, the bottom member having a circular flange portion and a tubular portion extending from the flange portion.

13. The apparatus according to claim 1 wherein the rotary drive includes a housing and a bottom member fastened to the housing, the bottom member having a circular flange portion and a tubular portion extending from the flange portion over the stub tube fastening the rotary drive to the flat bracket.

14. The apparatus according to claim 13 wherein the tubular portion of the bottom member has a pair of diametrically opposite lateral bores therethrough configured to align with one or more of the stub tube through bores.

15. The apparatus according to claim 14 further comprising a locking pin removably insertable through the lateral bores and two of the stub tube through bores to fasten the rotary drive to the flat bracket.

16. An apparatus for positioning a flexible lance drive device in registry with an opening into a heat exchanger tube sheet, the apparatus comprising:

a flat plate bracket adapted to be bolted parallel to a flange of the heat exchanger adjacent the heat exchanger tube sheet so as to extend parallel to the flange, the flat plate bracket carrying a stub tube fastened to and extending normal to the flat plate bracket, wherein the stub tube has a central axis and a plurality of lateral through bores intersecting the central axis;

a rotary drive removably fastened to the stub tube, the rotary drive having a first air motor coupled through a worm gear to a rotary disc rotatable in a plane parallel to the heat exchanger tube sheet;

a slotted box rail having a proximal end clamped to the rotary disc of the rotary drive; and a linear drive assembly removably fastened to the slotted box rail, the linear drive assembly including a second air motor coupled to a drive sprocket configured to engage slots in the slotted box rail for movement of the linear drive assembly back and forth along the slotted box rail; and a guide tube collet block assembly clamped to the linear drive assembly, wherein the guide tube collet block assembly is configured to removably support the flexible lance drive device and guide a flexible lance between the lance drive device and a selected one of a plurality of tubes penetrating through the heat exchanger tube sheet in order to feed the flexible lance into, through and back out of the selected tube.

17. The apparatus according to claim 16 wherein each of the through bores in the stub tube is spaced 30 degrees apart from an adjacent through bore and the rotary drive has a tubular coupling adapted to fit over the stub tube and may be selectively fixed on the stub tube with a locking pin extending through the coupling and through an aligned stub tube through bore.

18. The apparatus according to claim 16 wherein the guide tube collet block assembly includes a collet block fastened to one end of a guide tube and a dovetail slide fastened to one side of the collet block, the dovetail slide adapted to fit within a complementary clamp slot in the linear drive assembly to hold the guide tube collet block assembly to the linear drive assembly.

19. The apparatus according to claim 18 wherein the linear drive assembly include a pair of opposed rail slides fastened to a carriage plate for engaging raised corners of the box rail and guiding the linear drive assembly as it is driven via the drive sprocket engaging slots along the box rail.

20. The apparatus according to claim 16 wherein the linear drive assembly includes a guide tube removably fastened to the collet block via a bolted collet block cap.

* * * * *